US007021257B2

(12) United States Patent
Ekdahl et al.

(10) Patent No.: US 7,021,257 B2
(45) Date of Patent: Apr. 4, 2006

(54) COMPENSATING FOR VCT PHASE ERROR OVER SPEED RANGE

(75) Inventors: Earl Ekdahl, Ithaca, NY (US); Danny R. Taylor, Freeville, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 385 days.

(21) Appl. No.: 10/405,513

(22) Filed: Apr. 2, 2003

(65) Prior Publication Data

US 2003/0230264 A1 Dec. 18, 2003

Related U.S. Application Data

(60) Provisional application No. 60/389,201, filed on Jun. 17, 2002.

(51) Int. Cl.
*F01L 1/34* (2006.01)

(52) U.S. Cl. ..... 123/90.15; 74/568 R; 92/121; 123/90.17

(58) Field of Classification Search ..... 123/90.12, 123/90.15–90.17, 90.31; 74/568 R; 92/121, 92/122; 361/152, 154, 159, 160, 139
See application file for complete search history.

(56) References Cited

U.S. PATENT DOCUMENTS

| | | | | | |
|---|---|---|---|---|---|
| 4,928,640 | A | | 5/1990 | Van Vuuren et al. | 123/90.17 |
| 5,002,023 | A | | 3/1991 | Butterfield et al. | 123/90.15 |
| 5,107,804 | A | | 4/1992 | Becker et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,196,793 | A | | 3/1993 | Good et al. | 324/207.25 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,548,995 | A | * | 8/1996 | Clinton et al. | 73/116 |
| 5,671,145 | A | * | 9/1997 | Krebs et al. | 701/102 |
| 5,736,633 | A | * | 4/1998 | Magner et al. | 73/116 |
| 5,856,922 | A | | 1/1999 | Jehanno | 364/431.061 |

FOREIGN PATENT DOCUMENTS

| | | |
|---|---|---|
| EP | 0787892 A1 | 8/1997 |
| JP | 11082073 | 3/1999 |

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

A method for compensating for variable cam timing of an internal combustion engine is provided. The method includes: a) providing a periodical crank pulse signal; b) providing a periodical cam pulse signal; c) determining a segment, wherein the internal combustion engine speed induces a volatile change upon Zphase values; d) dividing the segment into sub-segments; and e) calculating Zphase values of a plurality of points within the sub-segments.

9 Claims, 6 Drawing Sheets

COMPENSATING FOR VCT PHASE ERROR OVER SPEED RANGE

REFERENCE TO RELATED APPLICATIONS

This application claims an invention which was disclosed in Provisional Application No. 60/389,201, filed Jun. 17, 2002, entitled "Compensating for VCT Error Over Speed Range." The benefit under 35 USC §119(e) of the U.S. provisional application is hereby claimed, and the aforementioned application is hereby incorporated herein by reference.

BACKGROUND OF THE INVENTION

1. Field of the Invention

The invention pertains to the field of variable camshaft timing VCT) systems. More particularly, the invention pertains to a method to compensate for VCT phaser error over speed range.

2. Description of Related Art

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotates with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

Furthermore, it is known in the art to use negative feedback loop for controlling variable camshaft timing (VCT) systems. U.S. Pat. No. 5,289,805 describes an improved closed loop feedback system for a VCT system. The same patent further teaches a robust control law used in the closed loop feedback system for a VCT system. The control law includes a phase integration (PI) block and a phase lead block. FIGS. 1 and 1A show the feedback loop and the control law respectively.

Referring to FIG. 1, a prior art feedback loop 10 is shown. The control objective of feedback loop 10 is to have the VCT phaser at the correct phase (set point 12) and the phase rate of change is zero. In this state, the spool valve 14 is in its null position and no fluid flows between two fluid holding chambers of a phaser (not shown). A computer program product which utilizes the dynamic state of the VCT mechanism is used to accomplish the above state.

The VCT closed-loop control mechanism is achieved by measuring a camshaft phase shift .$\theta_0$ 16 and comparing the same to the desired set point 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point 12 and phase shift $\theta_0$ 16) is non-zero.

The spool 14 is moved toward a first direction (e.g. right) if the phase error is positive (retard) and to a second direction (e.g. left) if the phase error is negative (advance). When the phase error is zero, the VCT phase equals the set point 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase difference is defined as the time from successive crank-to-cam pulses, divided by the time between successive crank pulses and multiplied by the angular distance corresponding to successive crank pulses (in degrees). In other words, the angular position difference is referenced to the difference between the cam shaft and the crank shaft. The measured phase difference may be expressed as $\theta_0$ 16. This phase difference is then supplied to the control law 18 for reaching the desired spool position.

Referring to FIGS. 1 and 1A, a control law 18 of the closed-loop 10 is described in U.S. Pat. No. 5,184,578 and is hereby incorporate herein by reference. A simplified depiction of the control law is shown in FIG. 1A. Measured phase 26 is subjected to the control law 18 initially at block 30 wherein proportional-integral (PI) process occurs. Typically PI process is subdivided into two sub-processes. The first sub-process includes an amplification action; and the second sub-process includes an integration action. Measured VCT phase is further subjected to phase compensation at block 32

With regard to the phase compensator 32, due to phase measurement variations over the speed range of engines used for variable cam timing (VCT), it is desirable to have a method suitable for automatically adjusting the phase measurement variation. Further, because of the variable reluctance sensors used for sensing, it is necessary to implement in the method a way for compensating undesirable erroneous phase shift. Based upon testing, it has shown that while engine speed ranging from 500 to 6000 rpm, the phase may shift ranging from as much as 8° to as little as 1° with reference to crank shaft position. In addition, the amount of the phase shift varies from phaser to phaser so a fixed table in the method will only average the error. Therefore, it is desirous to have a method to automatically implement phase compensation at various engine speeds such as a set of predetermined values for correction being stored for use in an engine control unit (ECU).

SUMMARY OF THE INVENTION

In a variable cam timing (VCT) system, a method is provided to compensate for phase measurement inaccuracies over a speed range of various types of engines.

Accordingly, a method for compensating for variable cam timing of an internal combustion engine is provided. The method includes: a) providing a periodical crank pulse signal; b) providing a periodical cam pulse signal; c) determining a segment, wherein the internal combustion engine speed induces a volatile change upon the measured zero phase (or Zphase) values; d) dividing the segment into sub-segments; and e) calculating Zphase values of a plurality of points within the sub-segments.

DETAILED DESCRIPTION OF THE INVENTION

Figure 2:
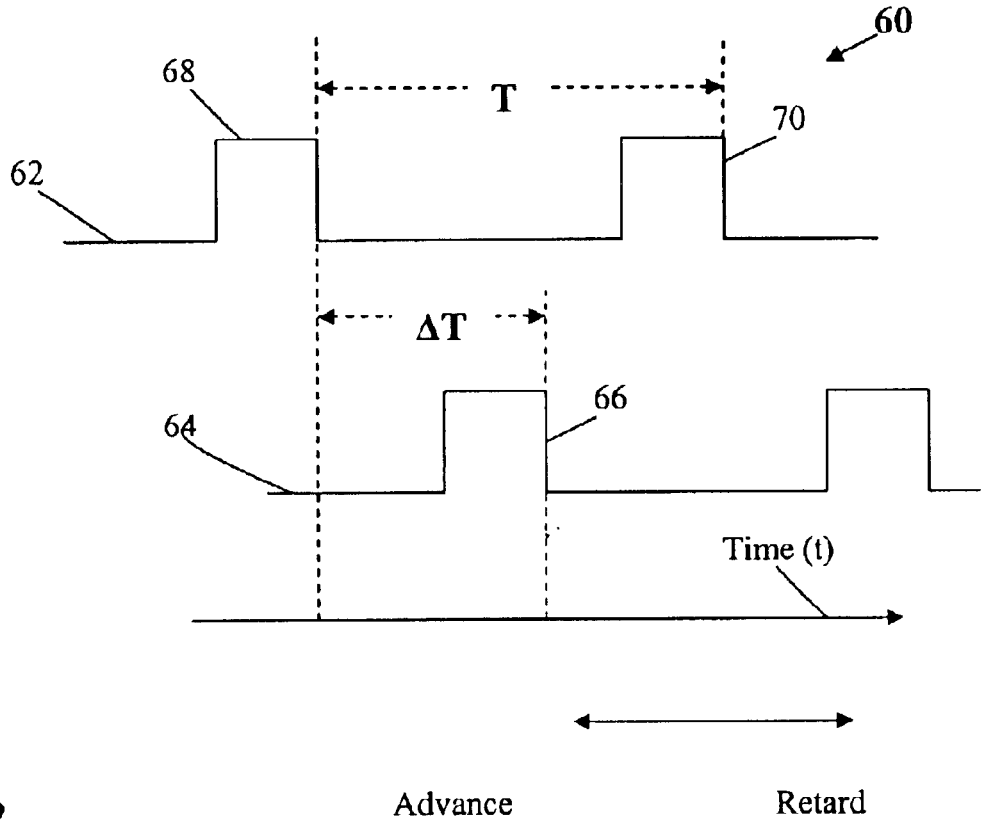
FIG. 2 shows a timing diagram depicting a relationship between a sequence of crank pulses and cam pulses.

In FIGS. 2–5, a generalized method implementing the present invention is shown. Referring to FIG. 2, a pulse relationship 60 between a sequence of periodical crank pulses 62 and a sequence of periodical cam pulses 64 is shown. The crank pulses 62 has a period T, which is defined as the time between the falling edges of adjacent pulses. The time between the falling edge 66 of a cam pulse and a previous falling edge 68 of crank pulse 62 is defined as ΔT.

A VCT phase calculation method is shown below:

$$\text{Phase}=(\Delta T/T*\text{Crank Angle})-Z\text{phase}$$

Where:

Phase denotes phase in degrees as referenced to crank position

ΔT is the time from a falling edge crank tooth signal 68 to the next falling edge 66 cam tooth signal, the time measured in microseconds or fractional microseconds.

T is the time between 2 applicable consecutive crank teeth falling edge signals, the time is measured in microseconds or fractional microseconds. T is always greater than ΔT.

Crank Angle=360/number of applicable evenly spaced crank teeth.

By way of examples: For 2 crank teeth, Crank Angle=180 degrees. For 3 crank teeth, Crank Angle=120 degrees. For 4 crank teeth, Crank Angle=90 degrees. Zphase or zero phase is a run time calculated offset value. The calibration may be operator or software triggered.

The number of teeth on the cam sensor wheel must be 2 times the number of "measurement teeth" on a crankshaft sensor wheel. There may be more teeth on the crankshaft sensor wheel than "measurement teeth". However, the number of teeth on the crankshaft needs to be an integral factor. For example, a crank sensor with 36 actual teeth, where 4 are "measurement teeth". In other words, a phase measurement may be initiated in software every 9th tooth, 36/9=4. This is the same as if the crank sensor wheel had only 4 teeth so this method works fine with a cam sensor wheel having 8 teeth.

The Zphase value is the calculated phase from the above equation. By substituting 0 for Zphase and having the phaser commanded to a known position, (for example, full advance, Zphase values can be obtained. Zphase is, in effect, a measure of the cam sensor wheel alignment with respect to the crank sensor wheel.

The Zphase calibration method ensures that mathematically the cam tooth signal (or pulses 64) occurs following the crank signal (or pulse 62) and within the window (or time segment) provided by the 1st and 2nd crank tooth signals 68, 70 respective. The result of this calibration operation is subtracted from the calculated phase as shown above so that mathematically the phase measurement occurs between 2 suitable crank tooth signals. To maintain an accurate phase relationship between the crank and cam shafts in a VCT system, a sufficiently accurate Zphase value at a particular engine speed need to be known by a controller such as ECU. Assuming that Zphase is not used in the phase calculation, the phase measurement may have a "cross over" situation where a cam tooth signal (or pulse 66 crosses the 2nd crank tooth signal (or pulse 70). If the above occurs, the phase measurement "rolls over" from a high value to a low value in degrees. This roll over is not desirous since the accuracy of measurement apparently is compromised.

Figure 3:
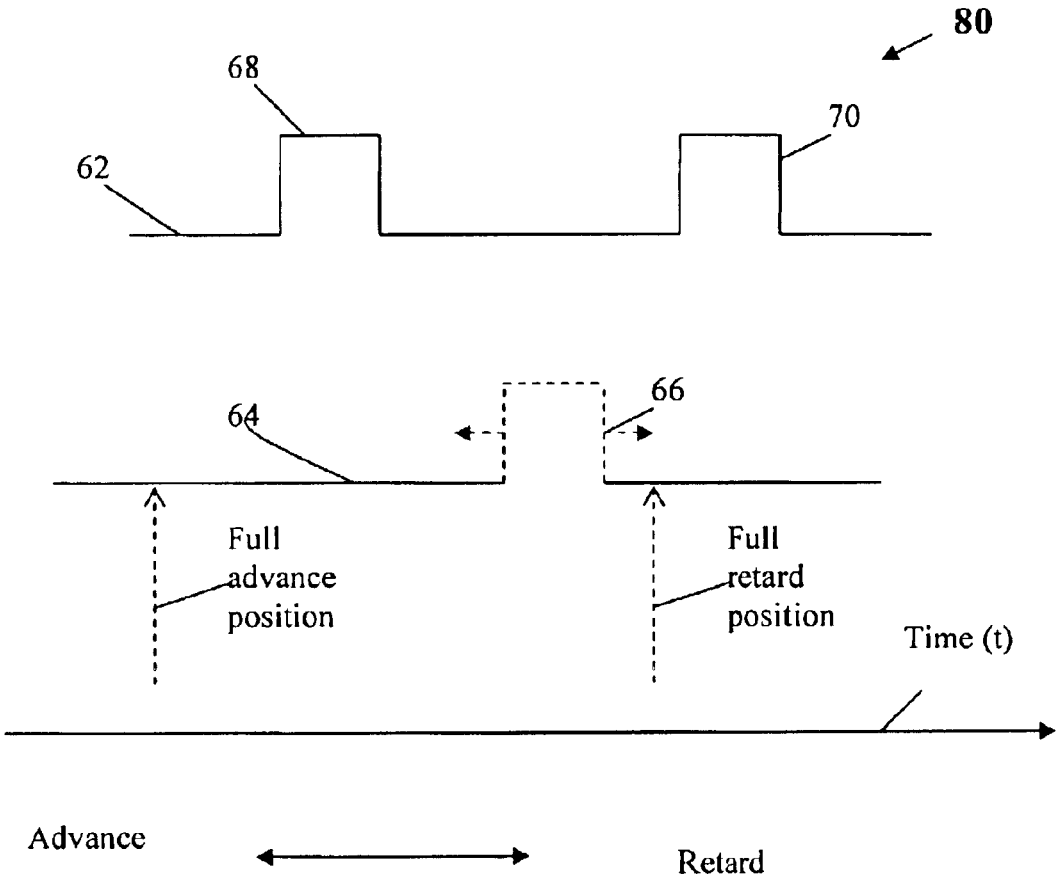
FIG. 3 shows the timing diagram of FIG. 2 in a more detailed form.

As shown in FIG. 3, for each cam pulse such as pulse 66, phaser measure is accurate only within a range starting at a full advance position and ending at a full retard position. The broken lines of pulse 66 and the arrows thereon denote the movement of pulse 66.

In order to get accurate measurements, the moving range for pulse 66 has to be within full advance position and full retard position as shown in FIG. 3.

The Zphase calibration is done by forcing both intake and exhaust cam solenoid inputs to 0 for a predetermined time period such as 3 seconds. By way of an example, an exhaust cam phaser is moved to full advance and the intake cam phaser is moved to full retard position. By way of the 3 second example, after 2 seconds or during the remaining 1 second, continuous phase measurements are taken and the lowest value is saved for each phaser.

For the exhaust cams, a small degree in value such as 2.5° to 5° is subtracted and the measurement becomes the exhaust Zphase values. For the intake cam, a bigger range of values such as 57.5° to 60.0°, corresponding to the full range of travel of the respective phasers, is subtracted and these values become the intake Zphase values.

To compensate for the sensor signal lag over the speed range, it is necessary to have several Zphase values taken at different RPM ranges. These Zphase values need to be known to a controller. For example, the values can be saved in an EEPROM memory in the micro-controller when controlling the VCT units. This is achieved by running the engine over a speed range such as between 500 to 6000 RPM. The controller needs to recognize each 500 RPM threshold or step, (it is allowable to have some tolerance such as a tolerance of 25 RPM) and calculates Zphase at that point for each phaser. The Zphase value for each phaser is then made accessible by the controller for subsequent use.

After the Zphase values are saved for all speed ranges, the method is then performed in its normal fashion, i.e., without Zphase corrections. It is noted that the method may be embedded in control software adapted to be used by a controller such as an engine control unit. The saved Zphase values or points are interpolated between the 500 RPM thresholds over the 500 to 6000 RPM range. These interpolated values are used when calculating the phase measurement by a controller such as the ECU.

Figure 4:
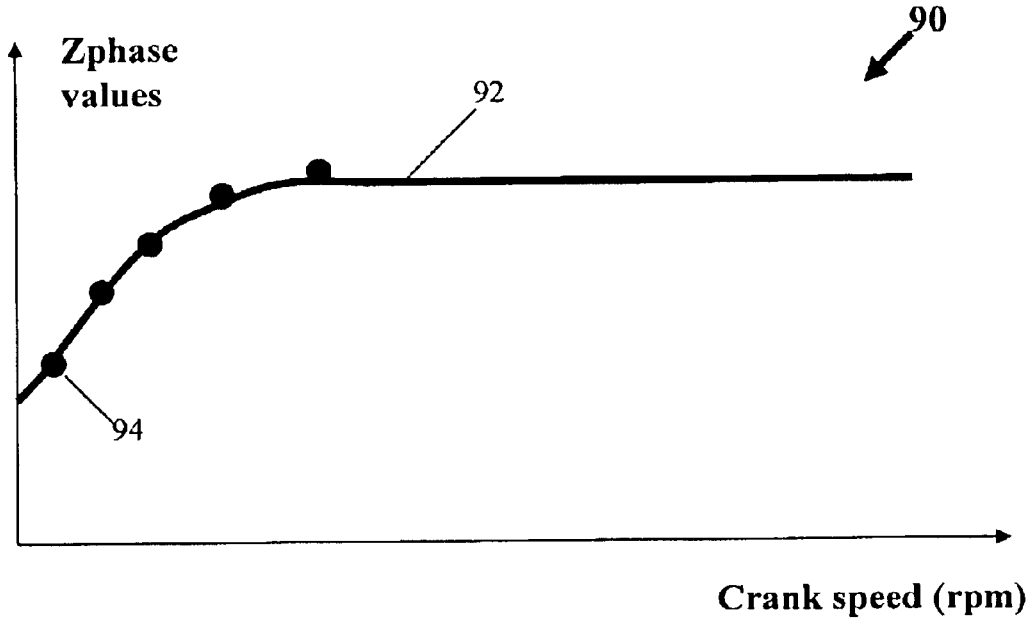
FIG. 4 shows a diagram depicting a relationship between Zphase values and engine speed.

Referring to FIG. 4, a diagram 90 shows the relationship between engine crank speed and Zphase value. A number of testing points are depicted on curve 92. For example, point 94 may denote crank speed at 500 rpm having a corresponding Zphase value. As can be appreciated, the variation of Zphase values occurs at only a segment of curve 92, i.e., the low engine speed range. These points that are shown in diagram 90 are used for Zphase calibration and for values between the points interpolation method are used. The values corresponding to the points may be stored in a non-volatile memory such ROM or EEPROM for future use. Further, the acquired values may be interpolated by the controller such as ECU. At higher engine speeds, Zphase values remains relatively stable hence fewer points may be necessary.

Figure 5:
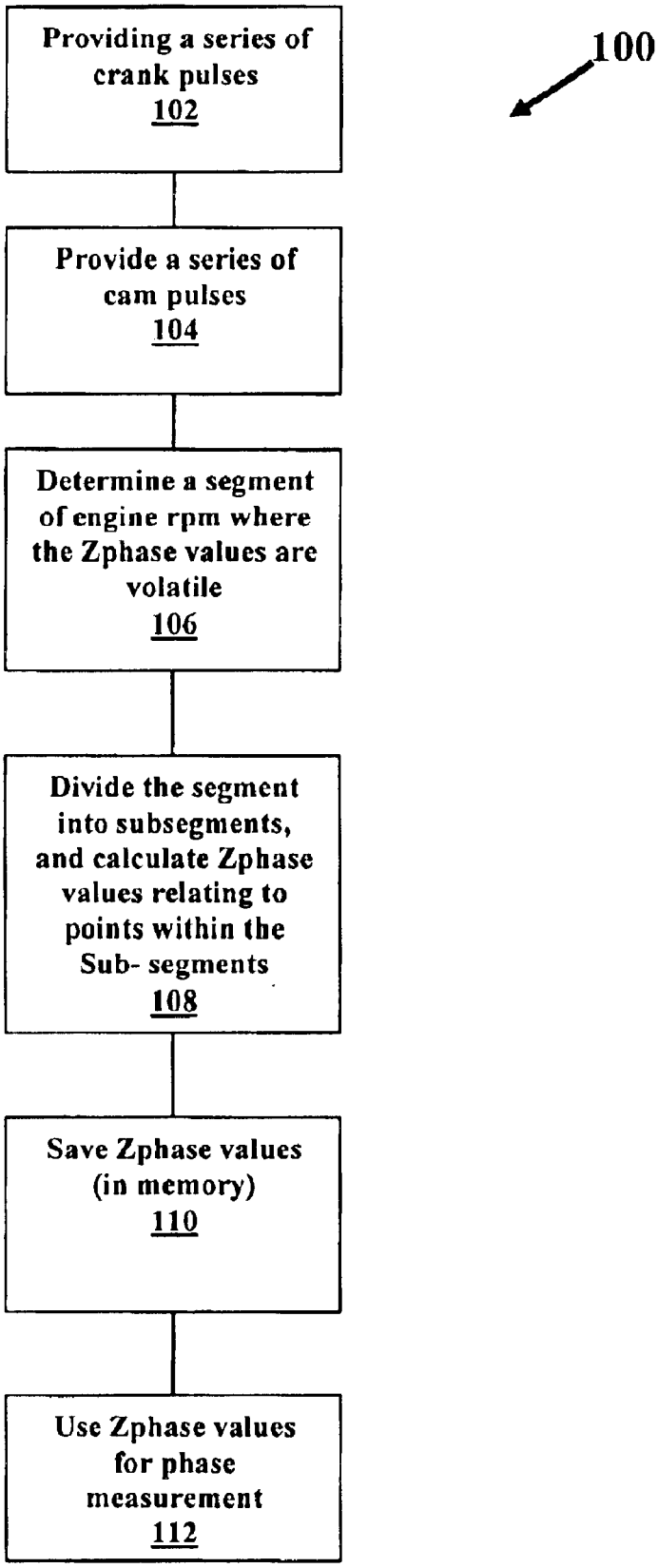
FIG. 5 shows a flowchart of the instant invention.

Referring to FIG. 5, a flowchart 100 for computing Zphase value is shown. A periodic crank pulse signal is provided (step 102). Further, a periodic cam pulse signal is provided (step 104). A volatile range of engine speed in relation to Zphase is determined (step 106). The range is volatile in that Zphase point values change relatively more in relation to engine speed changes (in rpm) than in other speed ranges. Outside the volatile range, the change is not as significant, the Zphase values therein may be considered as substantially constant. It is noted that the segment of engine rpm is equivalent to the range of engine speed. The volatile range is further subdivided into sub-segments and Zphase values are calculated using interpolation method (Step 108). The resultant Zphase values are saved in a memory device (Step 110). The memory device includes EEPROM, ROM, CD, or any suitable device for storing the values. The stored Zphase values are then retrieved for use during normal use of the engine operations.

It is noted that for different types of engines, or different production lots of engines, the Zphase values may vary. Therefore, the application of the instant method of calibration aids in reducing variable cam time errors. One embodiment of the present invention uses variable reluctance (VR) sensors. In other words, sensors 22*a* and 24*a* are VR sensors. In order to control Variable Cam Timing systems there is a need to measure the position of the camshafts with respect to the crankshaft. Also, with high accuracy VCT systems there is a need to measure this position with high accuracy. For example, an application may be required to control the cam position to within 2 degrees of the desired position, throughout most of the operating range. As can be seen, this is the total error allowed. The largest error contributors in the control system may be the camshaft and crankshaft position sensors. Therefore, the present invention includes teachings regarding the use of variable reluctance sensors and reducing its errors at low engine speeds. In one experiment, the range of engine speeds spans from about 500 to 3000 rpm.

For VR sensors, several factors may affect the accuracy of measurement, including: air gap, rotation speed, sensor wheel characteristics, and the material used as well as the thickness of the bracket whereopen the VR sensor is mounted thereon may cause variations in measurement. As can be appreciated, in present invention provides a method for compensating the above listed variations or factors, thereby allowing the use of inexpensive VR sensors rather than more expensive sensors such as Hall effect or magneto-resistive sensors to achieve high accuracy cam position measurements.

The present invention includes a method or process that has the step of using the Zphase values for reducing cam position measurement error during normal engine operations.

The present invention may also be incorporated into a differential pressure control (DPCS) system included in a variable cam timing (VCT) system. The DPCS system includes an ON/OFF solenoid acting upon a fluid such as engine oil to control the position of at least one vane oscillating within a cavity to thereby forming a desired relative position between the a cam shaft and a crank shaft. As can be seen the ON/OFF solenoid of the DPCS system is not of the variable force solenoid type.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Figure 1:
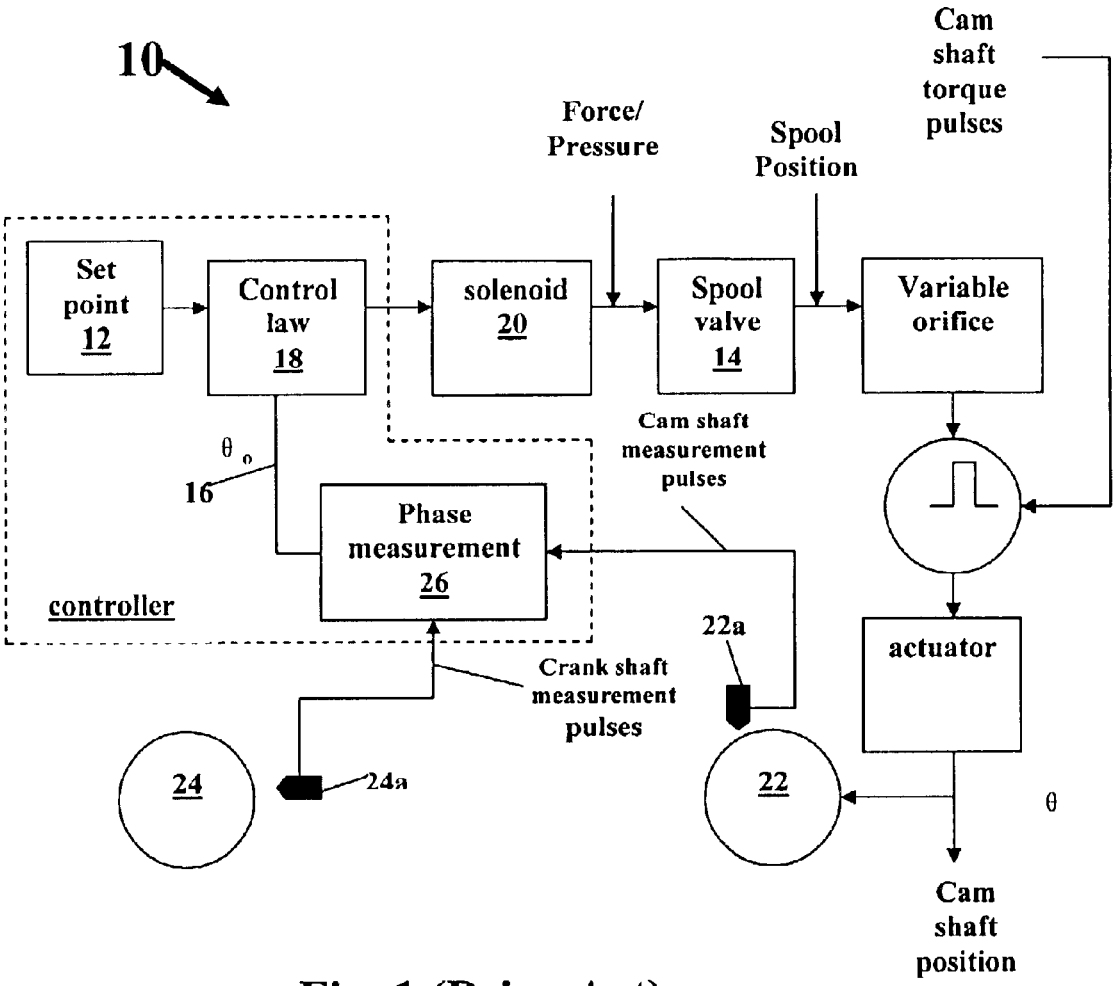
Fig. 1 (Prior Art)
FIG. 1 shows a prior art control loop.
Figure 1A:
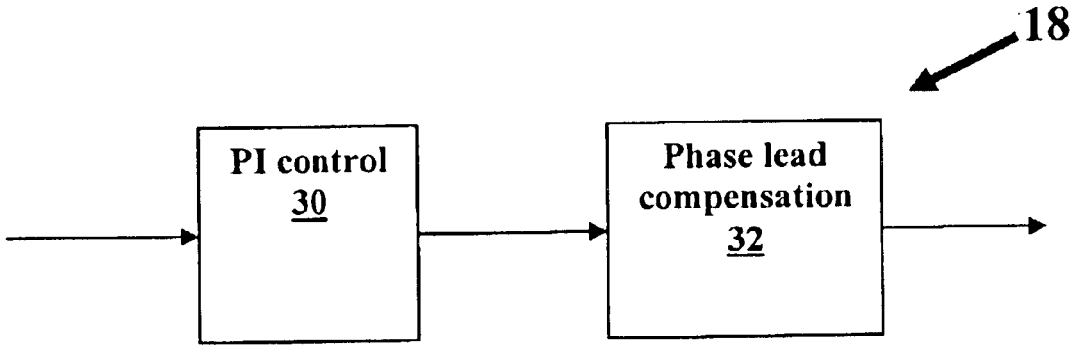
Fig. 1A (Prior Art)
FIG. 1A shows a portion of FIG. 1 in more detail.

One embodiment of the invention is implemented as a program product for use with a computer system such as, for example, the engine control unit and described below. The program(s) of the program product defines functions of the embodiments (including the methods described below with reference to FIGS. 1 and 5 and can be contained on a variety of signal-bearing media. Illustrative signal-bearing media include, but are not limited to: (i) information permanently stored on non-writable storage media (e.g., read-only memory devices within a computer such as CD-ROM disks readable by a CD-ROM drive); (ii) alterable information stored on writable storage media (e.g., floppy disks within a diskette drive or hard-disk drive); or (iii) information conveyed to a computer by a communications medium, such as through a computer or telephone network, including wireless communications. The latter embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for compensating for variable cam timing of an internal combustion engine comprising the steps of:

a) providing a periodical crank pulse signal;

b) providing a periodical cam pulse signal;

c) determining a segment, wherein the internal combustion engine speed induces a volatile change upon Zphase values;

d) dividing the segment into sub-segments; and e) calculating Zphase values of a plurality of points within the sub-segments.

2. The method of claim 1 further comprising the step of saving the Zphase values in a memory device.

3. The method of claim 1 further comprising the step of using the Zphase values for engine calibration.

4. The method of claim 1, wherein the calculating step calculates Zphase values using an interpolation method.

5. The method of claim 1, wherein the determining step includes performing experiment upon the engine.

6. The method of claim 1, wherein the periodical cam pulse signal includes at least one full advance position and full retard position in relation to the periodical crank pulse signal.

7. The method of claim 6, wherein the periodical cam pulse signal includes one cam pulse that is designated to be positioned within a range defined by the full advance position and the full retard position.

8. The method of claim 1, wherein the crank pulse signal and the cam pulse signal are provided using variable reluctance sensors.

9. The method of claim 1 further comprising the step of using the Zphase values for reducing cam position measurement error during normal engine operation.

* * * * *